US007486168B2

(12) United States Patent
Kim

(10) Patent No.: US 7,486,168 B2
(45) Date of Patent: Feb. 3, 2009

(54) SPIRAL INDUCTOR

(75) Inventor: Sung Su Kim, Jeonju-si (KR)

(73) Assignee: Dongbu Hitek Co., Ltd., Seoul (KR)

( * ) Notice: Subject to any disclaimer, the term of this patent is extended or adjusted under 35 U.S.C. 154(b) by 0 days.

(21) Appl. No.: 11/926,027

(22) Filed: Oct. 28, 2007

(65) Prior Publication Data

US 2008/0157913 A1 Jul. 3, 2008

(30) Foreign Application Priority Data

Dec. 29, 2006 (KR) ..... 10-2006-0137301

(51) Int. Cl.
*H01F 5/00* (2006.01)

(52) U.S. Cl. ..... 336/200; 336/223; 336/232

(58) Field of Classification Search ..... 336/200, 336/223, 232

See application file for complete search history.

(56) References Cited

U.S. PATENT DOCUMENTS

| | | | | |
|---|---|---|---|---|
| 5,831,331 | A * | 11/1998 | Lee | 257/659 |
| 6,075,427 | A * | 6/2000 | Tai et al. | 333/219 |
| 6,480,086 | B1 * | 11/2002 | Kluge et al. | 336/200 |
| 6,489,647 | B1 * | 12/2002 | Lin | 257/300 |
| 7,071,806 | B2 * | 7/2006 | Masu et al. | 336/200 |
| 7,082,580 | B2 * | 7/2006 | Zarkesh-Ha et al. | 716/1 |

* cited by examiner

*Primary Examiner*—Anh T Mai
(74) *Attorney, Agent, or Firm*—Workman Nydegger

(57) ABSTRACT

The present invention relates to a spiral inductor for use in a semiconductor device. The spiral inductor comprises a dielectric layer formed of a plurality of layers stacked on a semiconductor substrate, and a plurality of curved metal lines formed in the dielectric layers which are serially connected in order to form a circular spiral shape.

25 Claims, 12 Drawing Sheets

SPIRAL INDUCTOR

CROSS-REFERENCES AND RELATED APPLICATIONS

This application claims the benefit of Korean Patent Application No. 10-2006-0137301, filed on Dec. 29, 2006, which is hereby incorporated by reference in its entirety.

BACKGROUND OF THE INVENTION

1. Field of the Invention

The present invention relates to a semiconductor device. More specifically, the present invention relates to a spiral inductor for a semiconductor device.

2. Discussion of the Related Art

In order to generate inductance in the substrate of a semiconductor, semiconductor devices include inductors, which are generally formed from forming a metal wire into a spiral form. For example, in the configuration shown in FIG. 1, a metal wire 102 is formed into an inductor in a semiconductor substrate 100 by forming a spiral structure from a series of straight lines.

One difficulty in forming the spiral structure using a series of straight lines, however, is that polarization occurs at the edges of the metal wire, causing increased resistance in the inductor and a high parasitic capacitance between the metal lines. In particular, in configurations where the metal wire is formed directly on the semiconductor substrate, an eddy current may be generated on the semiconductor substrate, which impedes the operation of the any circuit, such as a transistor, which has been previously formed on the semiconductor substrate. Thus, one difficulty is that it is difficult to produce a high-quality inductor on the semiconductor substrate due to the loss caused by eddy currents or displace currents generated by the inductor of the current art.

BRIEF SUMMARY OF THE INVENTION

The present invention has been proposed in order to solve the problems in the related art described above. It is an object of the present invention to provide a spiral inductor capable of reducing parasitic capacitance between the metal lines of the inductor, reducing the loss due to eddy current or displaced current, and improving the quality of the inductor.

In order to accomplish the above object, the spiral inductor according to the present invention comprises: a dielectric layer formed of a plurality of layers stacked on a semiconductor substrate, and a plurality of curved metal lines buried in the dielectric layer which are serially inter-connected so as to form a spiral shape.

BRIEF DESCRIPTION OF THE DRAWINGS

The accompanying drawings are included to provide a further understanding of the invention and are incorporated in and constitute a part of this application. The drawings illustrate embodiment(s) of the invention and together with the description serve to explain the principle of the invention. In the drawings.

DETAILED DESCRIPTION OF THE INVENTION

Figure 1:
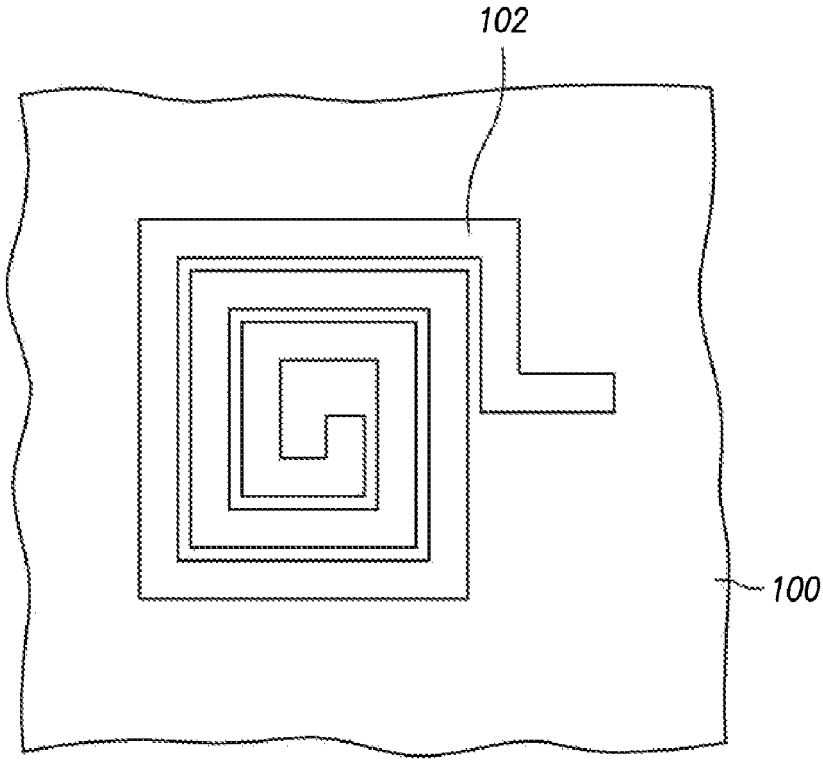
FIG. 1 is a plan view showing a spiral inductor according to the related art.

Hereinafter, preferred embodiments of a spiral inductor according to the present invention will be described in detail with reference to the accompanying drawings.

Hereinafter, the construction of the embodiments of the present invention will be described with reference to the accompanying drawings. The constitution of the present invention shown in the drawings and described in the detailed description are illustrated as at least one embodiment, and do not limit the technical idea, the core construction, or meaning of the present invention.

Embodiment 1

Figure 2A:
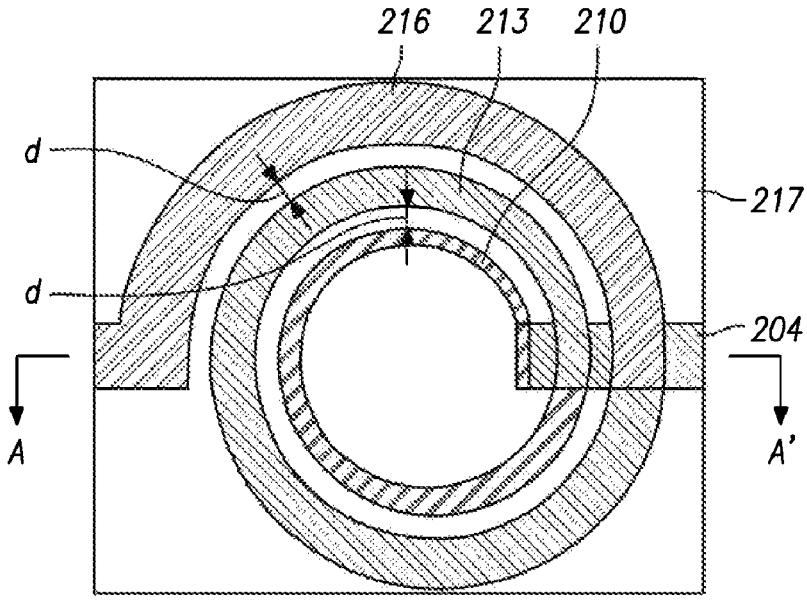
FIG. 2A is a projection view showing a first embodiment of a spiral inductor according to the present invention which is formed on a semiconductor substrate.
Figure 2B:
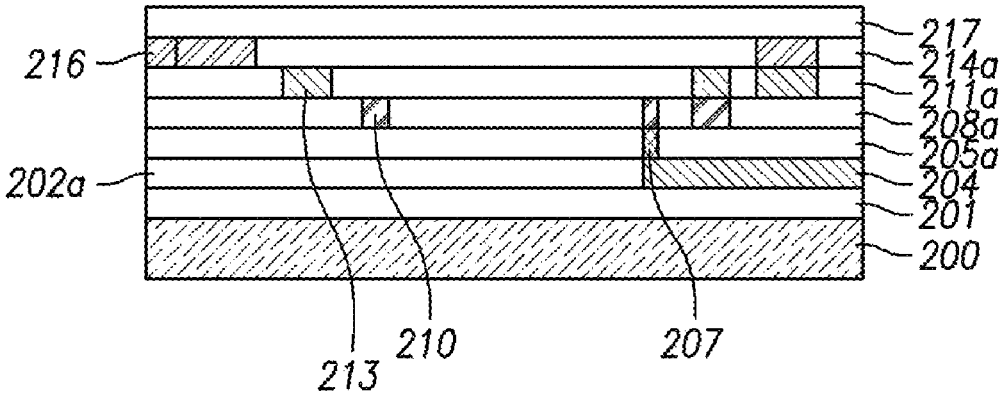
FIG. 2B is a cross-sectional view of the spiral conductor of the present invention taken along the A-A' lines of FIG. 2A.

FIGS. 2A and 2B illustrate a first embodiment of the spiral inductor according of the present invention, wherein FIG. 2A is a projection view showing the spiral inductor structure formed on a semiconductor substrate, and FIG. 2B is a cross-sectional taken the line A-A' of FIG. 2A.

In FIGS. 2A and 2B, the spiral inductor comprises a dielectric layer comprising a plurality of layers stacked on a semiconductor substrate 100 and a plurality of curved metal lines 204, 210, 213, and 216, which are formed and disposed between the dielectric layers 201, 202*a*, 205*a*, 208*a*, 211*a*, 214*a*, and 217 of the dielectric layer. The curved metal lines 204, 210, 213, and 216 are then and serially connected in order to form a circular spiral shape.

The metal lines 204, 210, 213, and 216 are serially connected, such that the metal lines 210, 213, and 216 form a circular spiral shape with a line width that gradually becomes increasingly narrow from an outer portion of the circular spiral to a center portion of the circular spiral, as viewed from the upper of the semiconductor substrate 200.

The circular spiral structure of the inductor is formed by means of the curved metal lines 210, 213, and 216 being serially connected.

Thus, as viewed from the upper surface of the semiconductor substrate 200, the circular spiral structure is formed so that the line width of the connected curved lines become increasingly narrow as proceeding toward the center portion.

In this configuration, it is preferable that a gap "d" is maintained between the curved metal lines 210, 213, and 216 of the circular spiral so as to remain constant.

In addition, a first metal line 210 formed at the center portion of the circular spiral is formed in a first dielectric layer 208*a*, whereas a second metal line 213 which is connected to the first metal line 210 is formed in a second dielectric layer 211*a*. A third metal line 216 connected to the second metal line 213 is formed in a third dielectric layer 214*a*. In this example, the first dielectric layer 208*a* in which the first metal line 210 is formed is the bottom dielectric layer, the second dielectric layer 211*a* in which the second metal line 213 is formed is formed on the first dielectric layer 208*a*, and the third dielectric layer 214*a* in which the third metal line 216 is formed is formed on the second dielectric layer 211*a*. Therefore, as seen in the cross-section in the FIG. 2B, the circular spiral is formed into an inverse cone shape.

As described above, when forming a spiral shape inductor using curved metal lines, the polarization phenomenon generated from the spiral inductor formed with straight lines can be prevented. Thus, the resistance within the inductor can be minimized, making it possible to maintain a high quality factor in the inductor.

In addition, since the width of the curved metal lines 210, 213, and 216 are gradually reduced from a first width in the outer portion to a smaller width in the center portion of the circular spiral, the loss due to eddy currents from the inductor can be reduced. Thus, inductance can be improved while maintaining a high quality factor.

Meanwhile, in the present invention the circular spiral may be formed in a cone-shape or an inverse cone-shape structure so that parasitic capacitance present between the metal lines forming the spiral can be reduced. Accordingly, the high quality factor can be maintained.

In order to form the cone-shape or the inverse cone-shape structure, there is height difference between the first curved metal line 210 disposed at the center portion of the circular spiral and the third curved metal line 216 disposed at the outer portion of the circular spiral. Also, there also are height differences among the metal lines 210, 213, and 216.

Accordingly, in one embodiment the first curved metal line 210 disposed at the center portion of the circular spiral is formed at a height that is higher than the third curved metal line 216 disposed at the outer portion of the circular spiral. Thus, each of the curved metal lines 210, 213, and 216 are formed at different heights so as to form the cone shape. This will be described in another embodiment below.

In another embodiment wherein the metal lines 210, 213, and 216 form an inverse cone shape, the first metal line 210 disposed at the center portion of the circular spiral is formed at a height that is lower than the height of the third metal line 216 disposed at the outer portion of the circular spiral. Thus, the metal lines are formed at the different heights to form a reverse cone shape.

In addition, the inductor according to the present invention further comprises a first connecting terminal connected to one end of the first metal line 210 disposed at the center portion of the circular spiral, and a second connecting terminal connected to one end of the third metal line 216 disposed at the outermost portion of the circular spiral. By way of example, the fourth metal line 204 formed in the lower dielectric layer 202*a* described above can be the first connecting terminal. Moreover, the fourth metal line 204 serving as the first connecting terminal may be connected to the first metal line through a metal plug 207.

The second connecting terminal (not shown) is contacted to an external circuit in order to connect one end of the third metal line 216 to an external circuit.

Here, the fourth metal line 204 used as the first connecting terminal is isolated from the second and third metal lines 213 and 216, by placing at least one dielectric layer 205*a*, or 205*a* and 208*b* between the fourth metal line 204 and the second and third metal lines 213 and 216.

A dielectric layer 201 is disposed between the metal line formed in the bottom layer, the fourth metal line 204 in this case, and the semiconductor substrate 200. The thickness of the dielectric layer 201 is preferably between 0.01 and 3 μm, and more preferably, 1 μm or more.

As described above, a thick dielectric layer is disposed between the fourth metal line 204 in the bottom dielectric layer and the semiconductor substrate so that the eddy current induced by the inductor does not formed on the silicon substrate, and remains inside of the interposed dielectric layer 201, since the resistance of the dielectric layers are much larger than the silicon substrate. Thus, the loss due to the eddy current may be reduced.

In this embodiment, the first connecting terminal 204 connected to the one end of the first metal line 210 is disposed at the center portion of the circular spiral, so as to overlap with the other metal lines, as viewed from above. It is preferable that the plurality of the metal lines 210, 213, and 216 are interconnected at the overlapped area. Thus, the plurality of the metal lines 210, 213, and 216 forming the circular spiral are serially connected in the overlapping area.

The width of the metal line in the area where the metal line is connected to the first connecting terminal 204 is gradually increased as the metal lines proceed from the center portion to the outer portion of the circular spiral. This reduces the parasitic capacitance generated between the first connecting terminal 204 and the metal lines 210, 213, and 216.

Also, the connection between the metal lines 210, 213, and 216 is formed in the overlapping area of the first connecting terminal 204 so that the parasitic capacitance generated in the area where the metal lines 210, 213, and 216 in the connection area is also reduced.

Now, a method forming the spiral inductor of the present invention will be described with reference to FIGS. 3 to 11.

Figure 3:
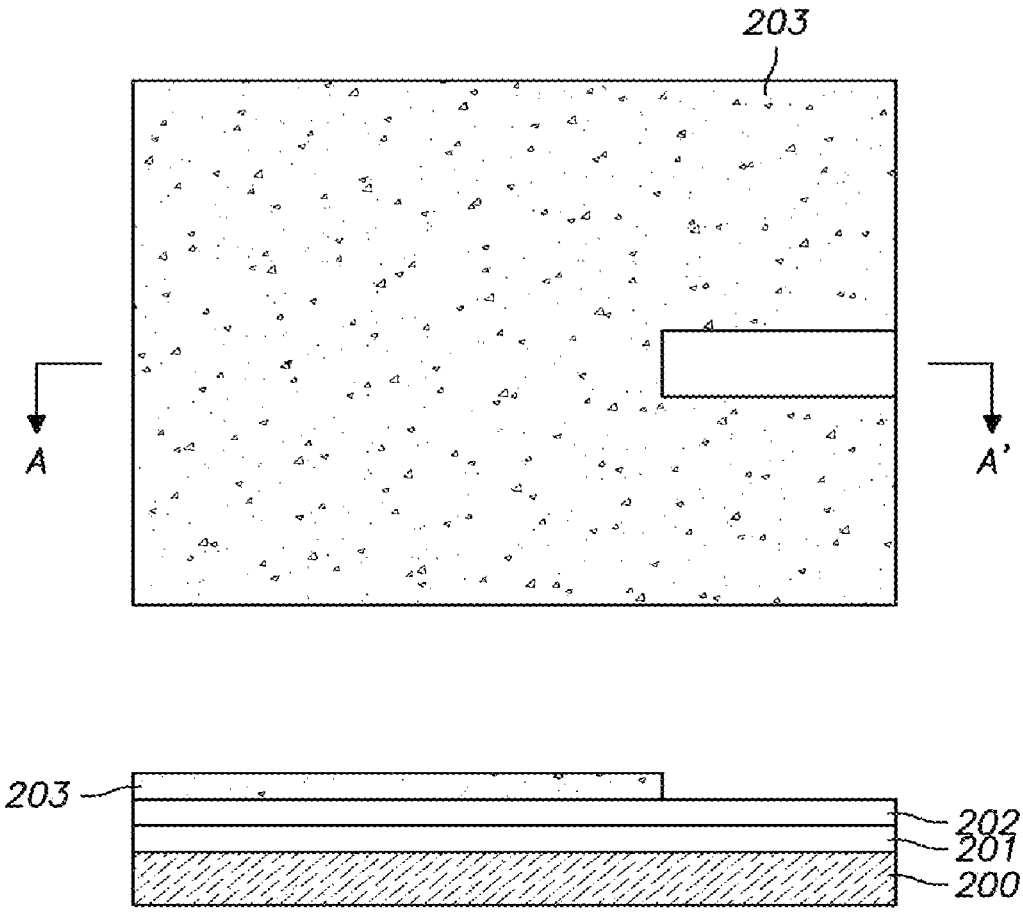
FIGS. 3 to 11 are projection views and cross-sectional views for explaining a method for forming the spiral inductor according to the first embodiment of the present invention.

First, as shown in FIG. 3, after forming a first dielectric layer 201 and a second dielectric layer 202 on a semiconductor substrate 200, a first photo resist pattern 203 is formed in order to form a fourth metal line 204 for a first connecting terminal on the second dielectric layer 202. Then, the second dielectric layer 202 is selectively etched in an etching process using the first photo resist pattern 203 so as to form a second dielectric pattern 202*a*.

Figure 4:
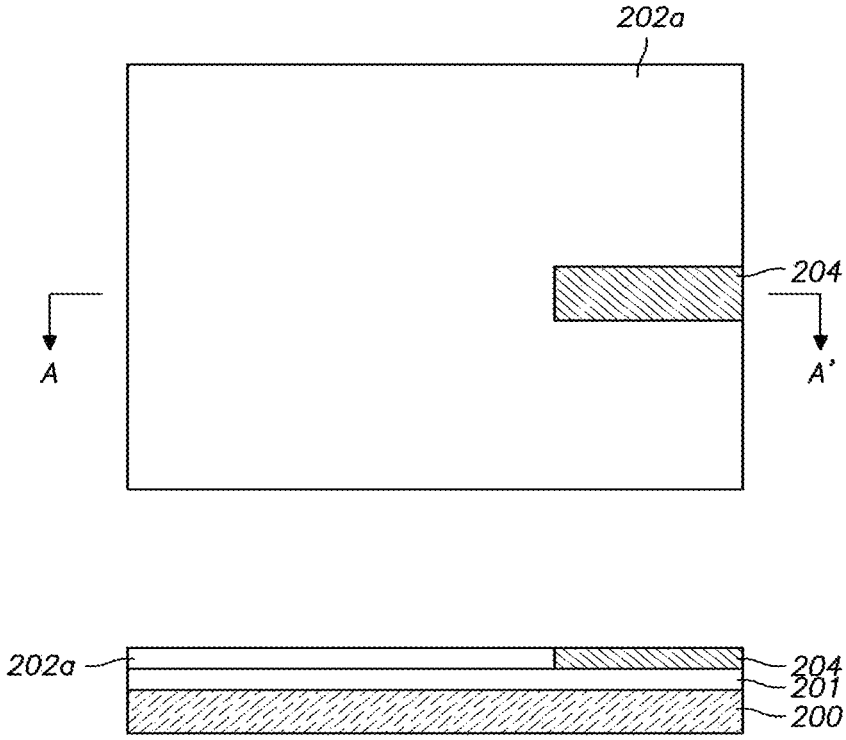

Then, ashing and cleaning processes are performed to remove the first photo resist pattern 203. Subsequently, a first metal film is deposited on the second dielectric layer 202*a* pattern, and a planarization process is performed on the first metal film by means of a chemical mechanical polishing (CMP) method so as to form the fourth metal line 204 for the first connecting terminal, as shown in FIG. 4.

Figure 5:
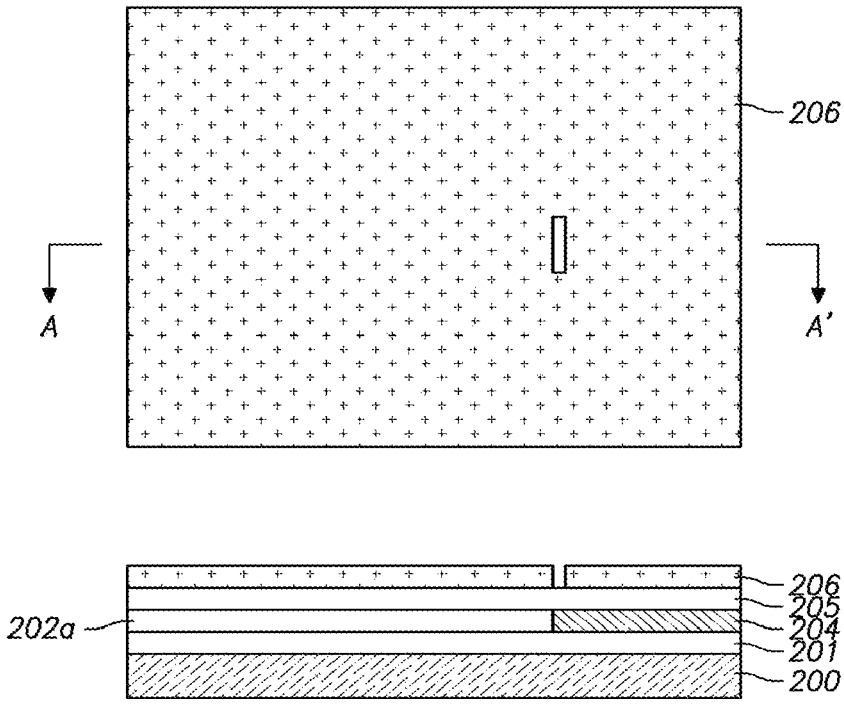

Next, as shown in the FIG. 5, a third dielectric layer 205 is formed over the semiconductor substrate 200 and fourth metal line 204, and a second photo resist pattern 206 is formed so as to form a contact hole on the third dielectric layer 205. Then, the third dielectric layer 205 is selectively etched in an etching process using the second photo resist pattern 206, so as to form the contact hole.

Figure 6:
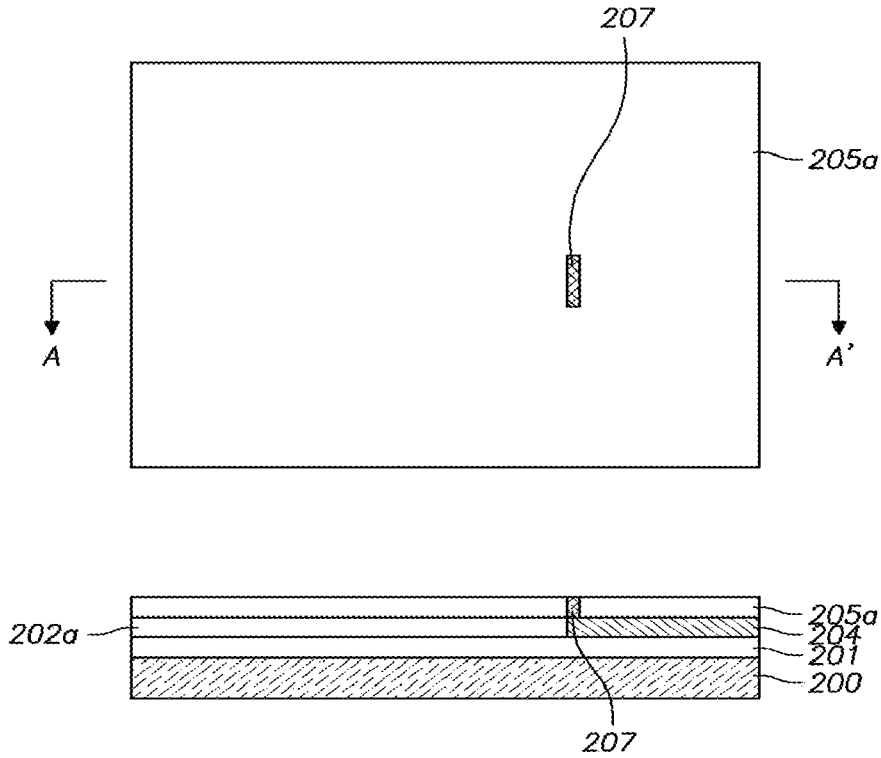

Subsequently, as shown in FIG. 6, after depositing a second metal film over the semiconductor substrate 200 and contact hole, a planarization process performed on the second metal film using a chemical mechanical polishing (CMP) method in order to form a metal plug 207 which is connected to the fourth metal line 204.

Figure 7:
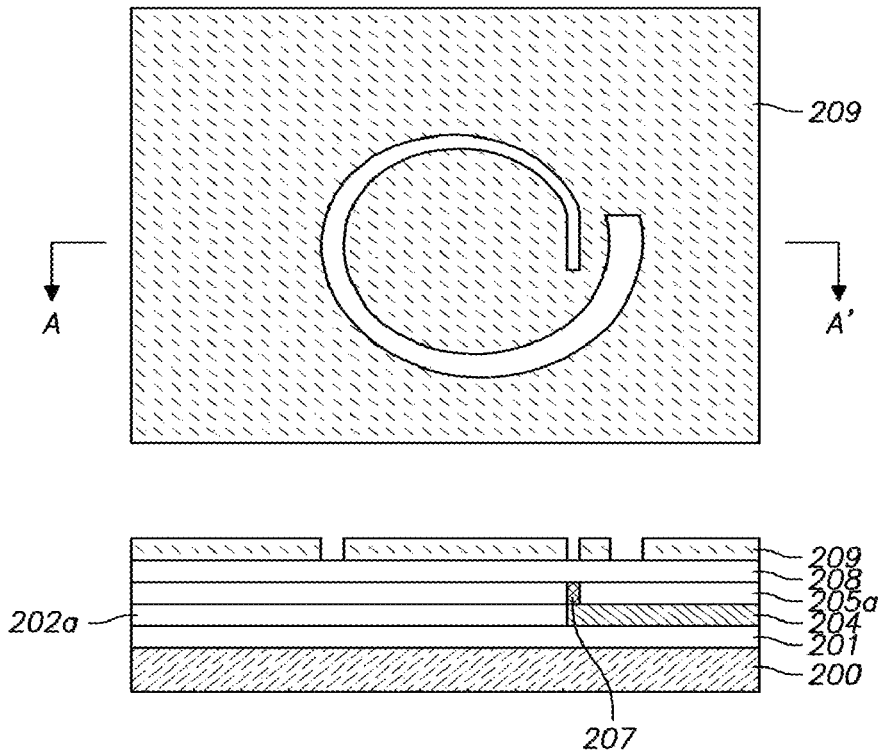

Next, as shown in FIG. 7, a fourth dielectric layer 208 is formed over the semiconductor substrate 200 and metal plug 207, and a first spiral photo resist pattern 209 is formed on the fourth dielectric layer 208. The first spiral photo resist pattern 209 is formed so as to have an opening in an approximately circular shape using the center of the resulting circular spiral as an axis, wherein the width of the opening is gradually increased from the width of the opening at the metal plug 207.

Next, a first dielectric layer pattern 208*a* is formed by performing the etching process using the first photo resist pattern 209. Then ashing and cleaning processes are performed in order to remove the first spiral photo resist pattern 209. Subsequently, a third metal film is deposited over the semiconductor substrate 200 and first dielectric layer pattern 208*a*. Then a planarization process is performed on the third metal film using a chemical mechanical polishing method.

Figure 8:
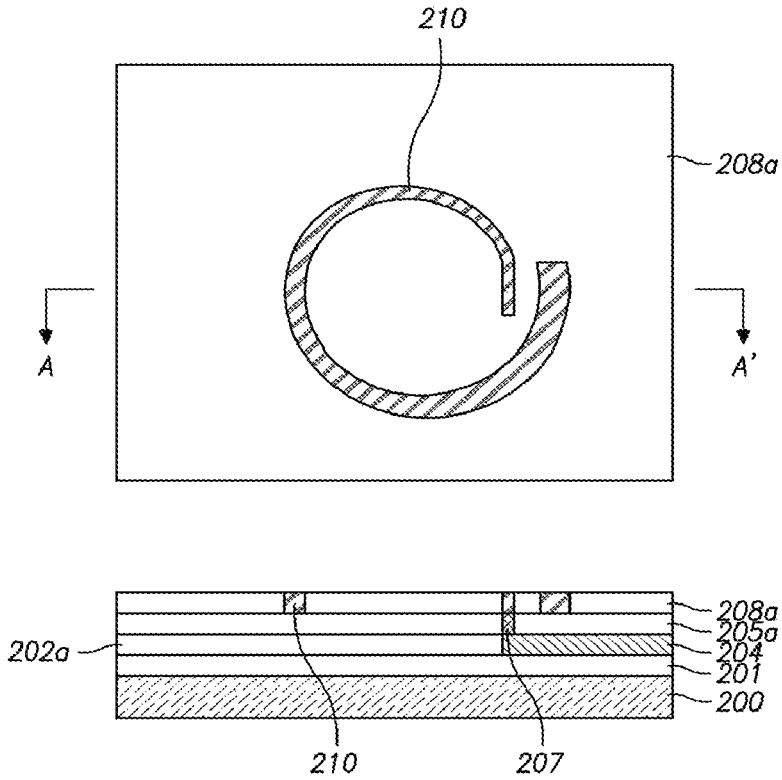

Thus, as shown in FIG. 8, a first spiral metal line 210 is formed with one end is connected to the metal plug 207. Here, the first metal line 210 is formed so that the line width of the spiral metal line is gradually reduced as proceeding from the center portion of the circular spiral.

Figure 9:
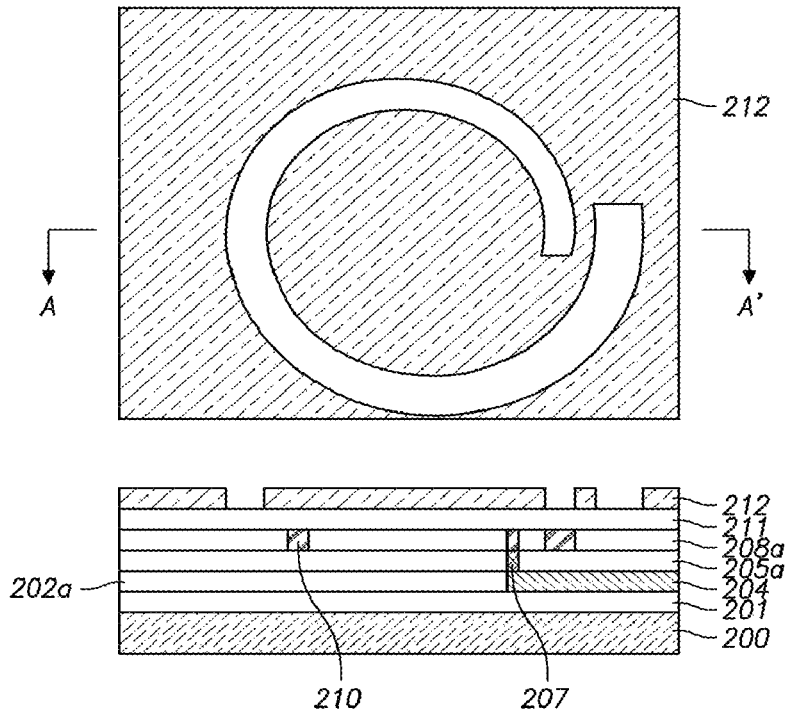

As shown in FIG. 9, a fifth dielectric layer 211 is formed over the semiconductor substrate 200 and first metal line 210 and a second spiral photo resist pattern 212 is formed on the fifth dielectric layer 211. After forming a fifth dielectric layer pattern 211*a* by performing the etching process using the second spiral photo resist pattern 212, the ashing and cleaning processes are performed so as to remove the second spiral photo resist pattern 212.

Figure 10:
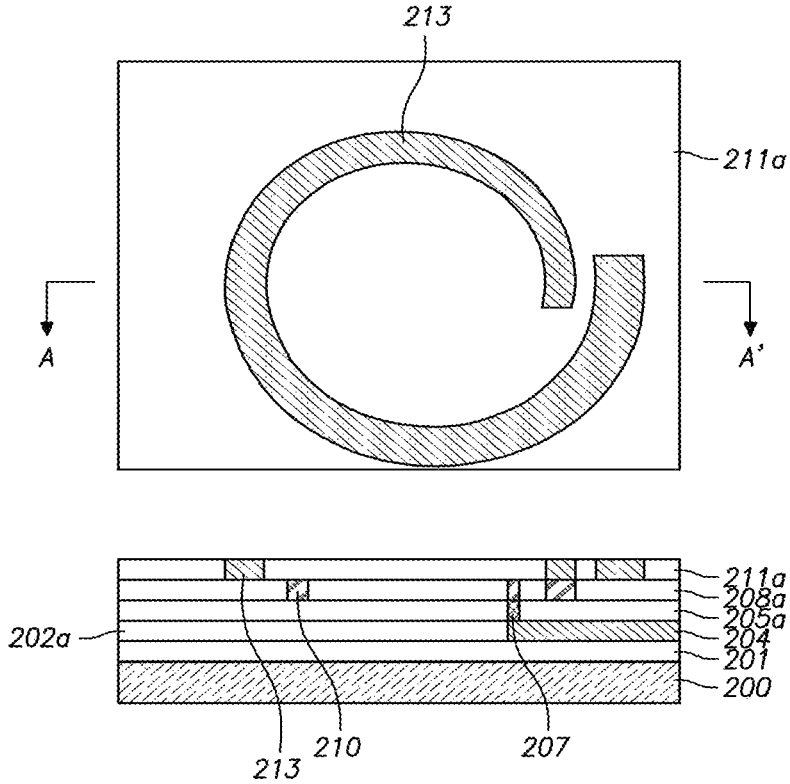

Subsequently, as shown in FIG. 10, a fourth metal film is deposited over the semiconductor substrate 200 and fifth dielectric layer pattern 211*a*, Then a planarization process is performed on the fourth metal film using a chemical mechanical polishing method so as to form a second spiral metal line 213 which is serially connected to the first metal line 210. Here, the second metal line 213 is formed so as to have a width that gradually increases towards the outer portion of the circular spiral.

Figure 11:
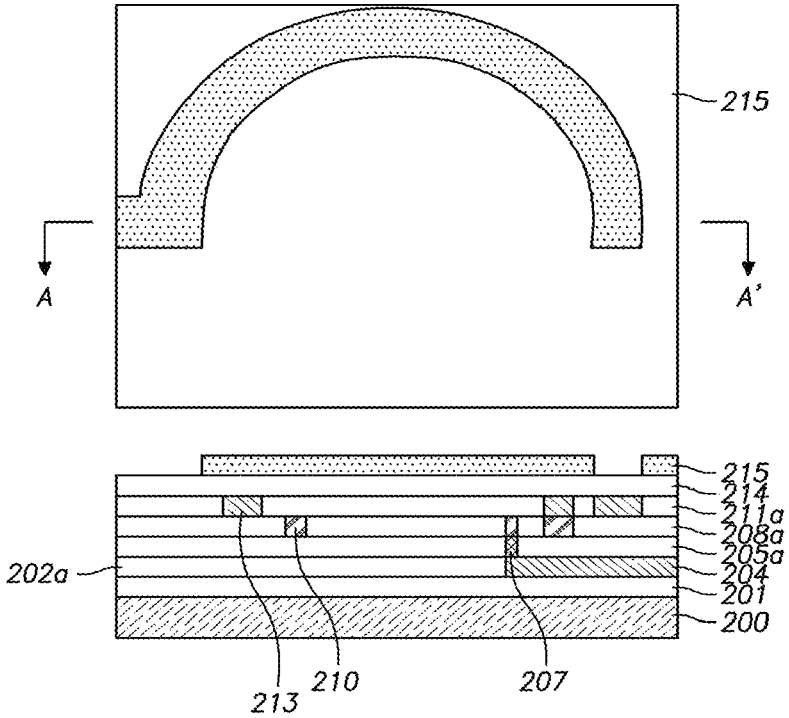

As shown in FIG. 11, a sixth dielectric layer 214 is formed over the semiconductor substrate 200 and second metal line 213, and a third spiral photo resist pattern 215 is formed on the sixth dielectric layer 214. After forming the sixth spiral dielectric layer 214*a* by performing the etching process using a third spiral photo resist pattern 215, ashing and cleaning processes are performed so as to remove the third spiral photo resist pattern 215.

Thereafter, a sixth metal film is deposited over the semiconductor substrate 200 and sixth spiral dielectric layer 214*a*, and a planarization process is performed on the sixth metal film using a chemical mechanical polishing method so as to form a third spiral metal line 216 with one end being connected to the second metal line 213. Subsequently, a seventh dielectric layer 217 is formed over the semiconductor substrate 200 and third metal line 216 so as to complete the spiral inductor having the structure shown in FIG. 2.

Embodiment 2

Figure 12:
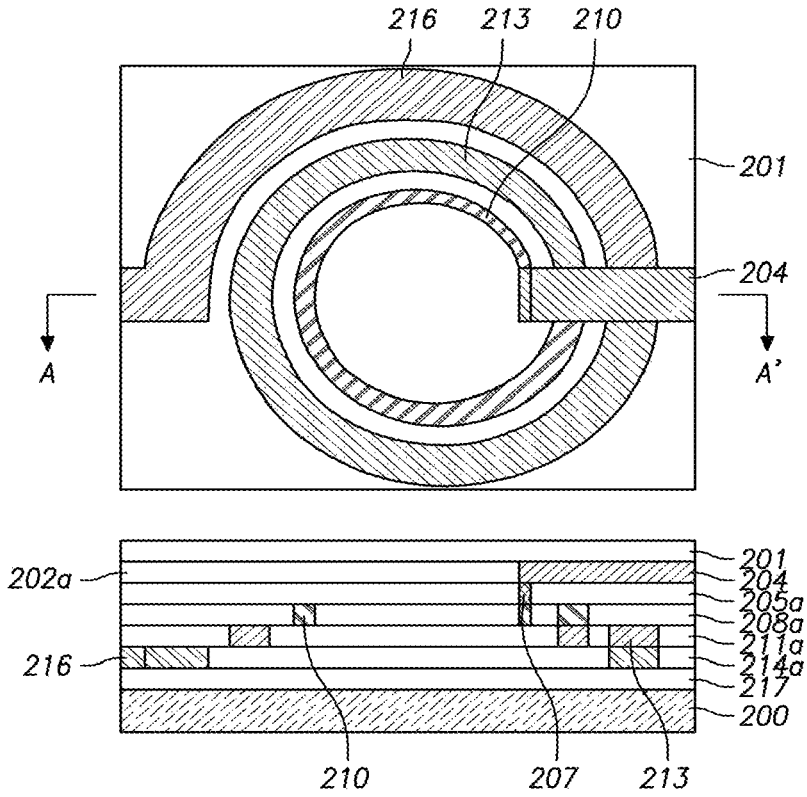
FIG. 12 is a projection view and a cross-sectional view showing a spiral inductor according to a second embodiment of the present invention.

Another embodiment of a spiral inductor according to the present invention is shown in FIG. 12, wherein the circular spiral is formed with a structure that is the inverse of the structure shown in FIG. 2.

That is, the first metal line 210 of the center portion of the circular spiral is disposed in the top layer, and the third metal line 216 is disposed in the bottom layer. Thus, the circular spiral is formed with a cone shape.

Accordingly, a circular spiral structure wherein the width of the spiral gradually decreases from a first width in the third metal line 216 disposed at the bottom layer to a second width in the first metal line 210 disposed in the top layer.

The method for forming the spiral inductor shown in the FIG. 12 is similar to the first embodiment, and differs only in the order that the photo masks for forming the spiral photo resist pattern are used.

Similarly to the first embodiment described above, in the second embodiment an extra dielectric layer 217 is also disposed between the third metal line 216 of the bottom layer and the semiconductor substrate 200, the thickness of the dielectric layer 217 preferably being between 0.01 and 3 μm, and more preferably, at least 1 μm or more.

Embodiment 3

Figure 20:
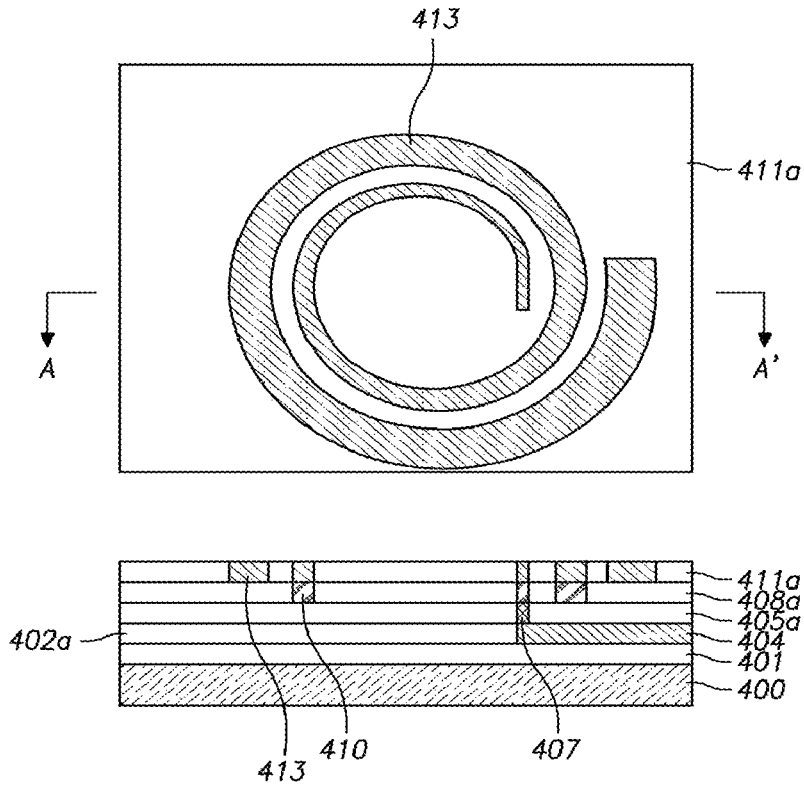
Figure 21:
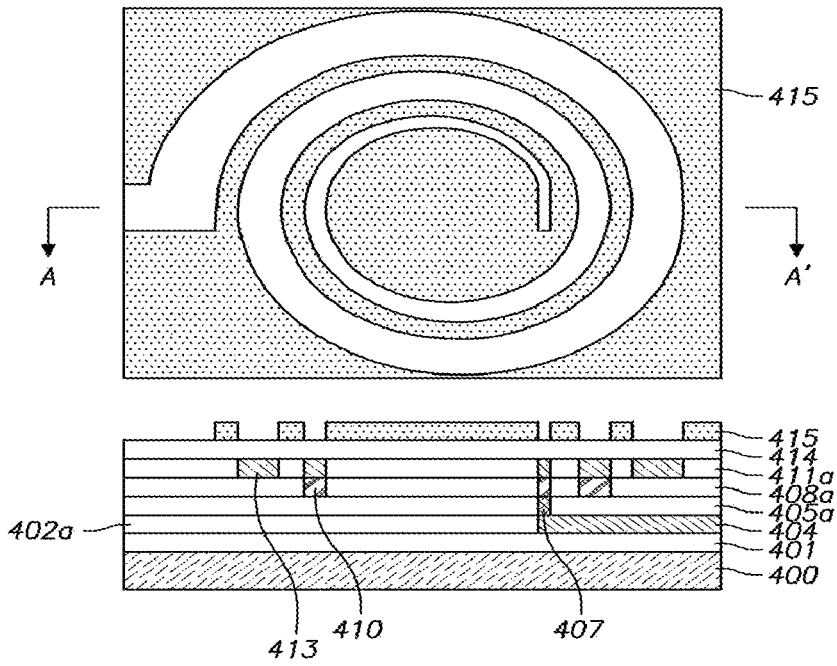
Figure 22:
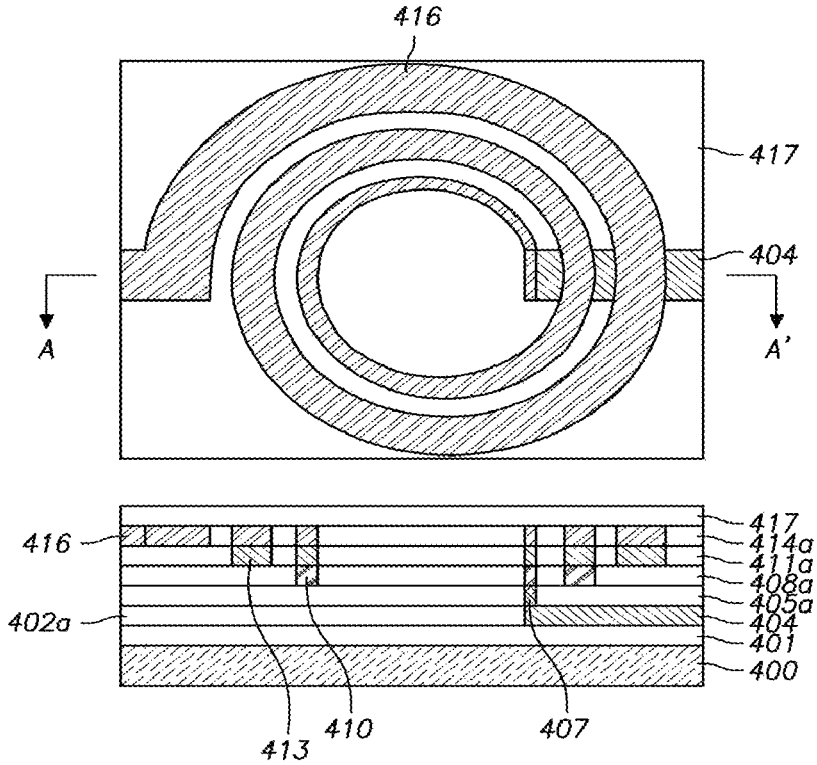

FIGS. 13 to 22 are plan views and cross-sectional views illustrating a spiral inductor and method for forming the same according to a third embodiment of the present invention. The spiral inductor according to the third embodiment shown in FIG. 22 is constituted of a circular spiral in an inverse cone shape, similar to the spiral inductor shown in FIG. 2.

The spiral inductor according to the third embodiment differs in that it has a shape wherein the width of the metal line is increased in a series of steps proceeding from the outer portion of the circular spiral to the center portion of the circular spiral. Hereinafter, the method for forming the spiral inductor according to the third embodiment will be described in detail.

Figure 13:
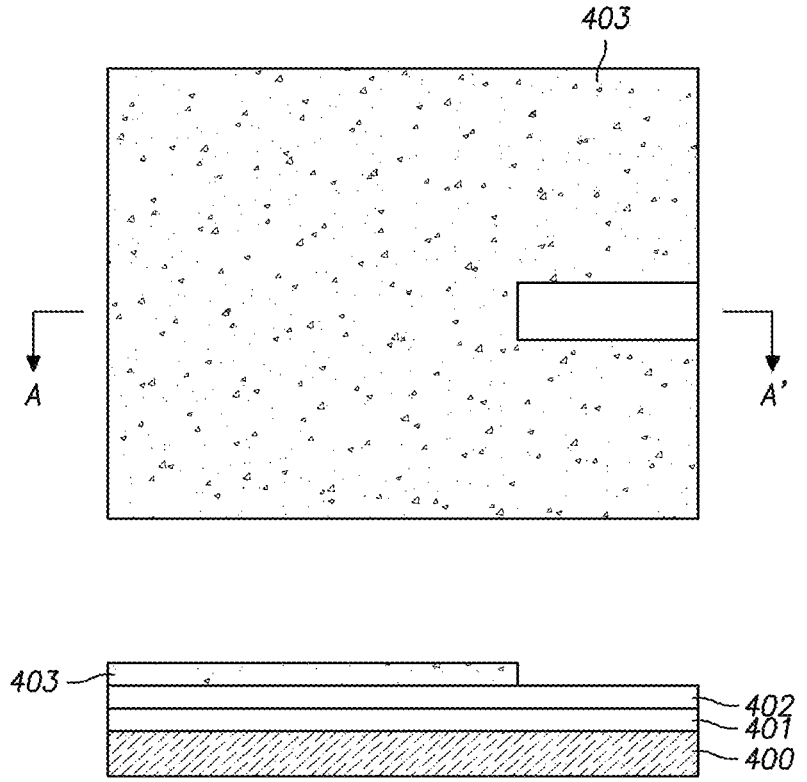
FIGS. 13 to 22 are projection views and cross-sectional views illustrating a structure of a spiral inductor and a method for manufacturing the same according to a third embodiment of the present invention.

First, as shown in FIG. 13, a first dielectric layer 401 and a second dielectric layer 402 are sequentially formed on a semiconductor substrate 400, with a first photo resist pattern 403 being formed on the second dielectric layer 402. Subsequently, a second dielectric layer pattern 402*a* is formed by performing an etching process using the first photo resist pattern 403. Then, ashing and cleaning processes are performed to remove the first photo resist pattern 403.

Figure 14:
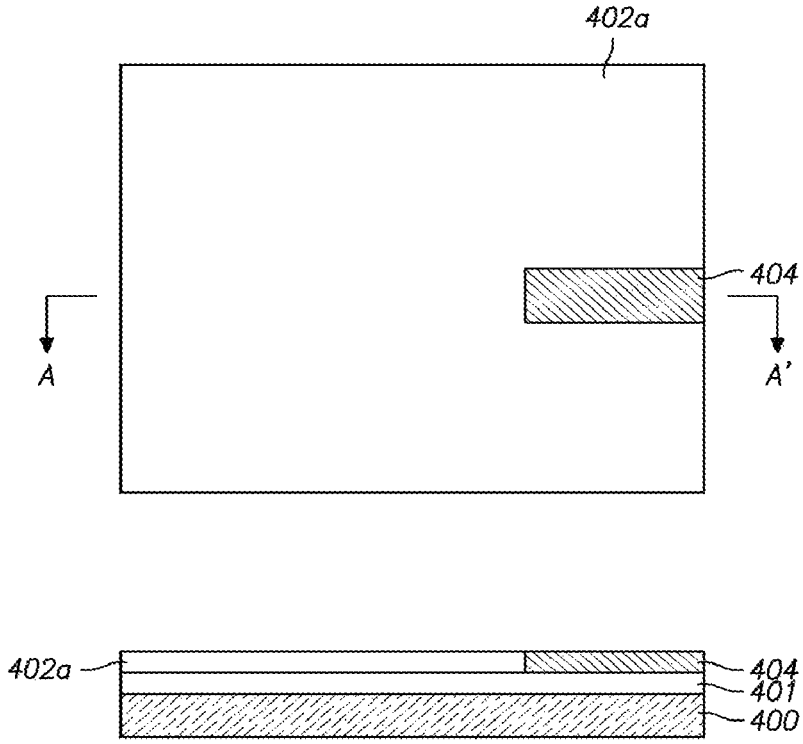

Thereafter, as shown in FIG. 14, a first metal film is deposited on the second dielectric layer pattern 402*a*, and a planarization process is performed on the first metal film using a chemical mechanical polishing (CMP) method so as to form a metal line 404 for a first connecting terminal.

Figure 15:
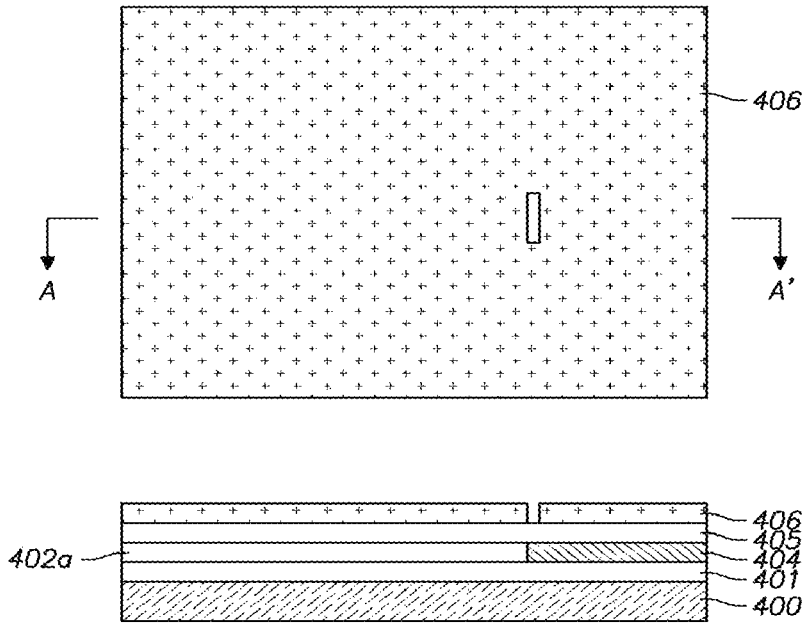

Next, as shown in FIG. 15, a third dielectric layer 405 is formed on the second dielectric layer pattern 402*a* and metal line 404, and a second photo resist pattern 406 for forming a contact hole is formed on the third dielectric layer 405. Subsequently, a contact hole is formed in the third dielectric layer 405 by performing an etching process using the second photo resist pattern 406. Then, ashing and cleaning processes are performed so as to remove the second photo resist pattern 406.

Figure 16:
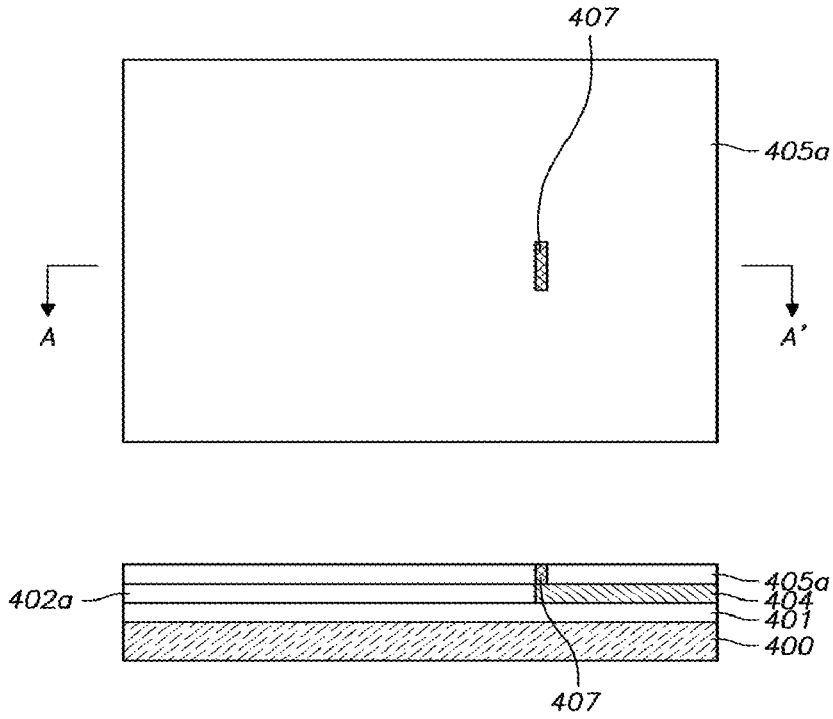

Thereafter, as shown in FIG. 16, a second metal film is deposited over the semiconductor substrate 400 and a planarization process is performed on the second metal film using a chemical mechanical polishing (CMP) method so as to form a metal plug 407 connected to the metal line 404.

Figure 17:
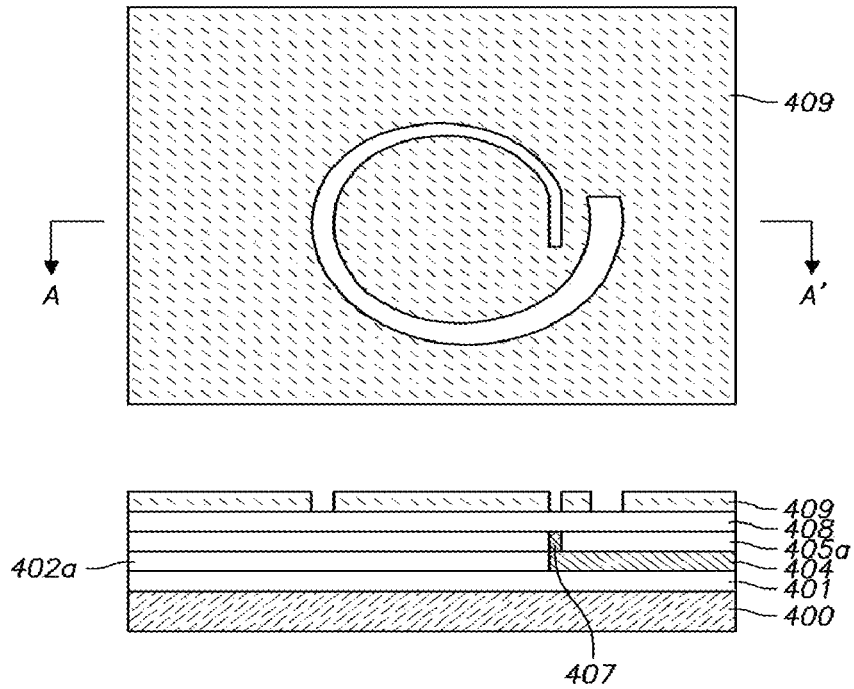

Subsequently, as shown in FIG. 17, a fourth dielectric layer 408 is formed on a third dielectric layer pattern 405*a*, and a first spiral photo resist pattern 409 is formed on the fourth dielectric layer 408. The first spiral photo resist pattern 409 has an opening in substantially the same shape as the first spiral photo resist pattern 209 of the first embodiment. Next, a fourth spiral dielectric layer pattern 408*a* is formed by selectively etching the fourth dielectric layer 408 using the first spiral photo resist pattern 409. Then ashing and cleaning processes are performed in order to remove the first spiral photo resist pattern 409.

Figure 18:
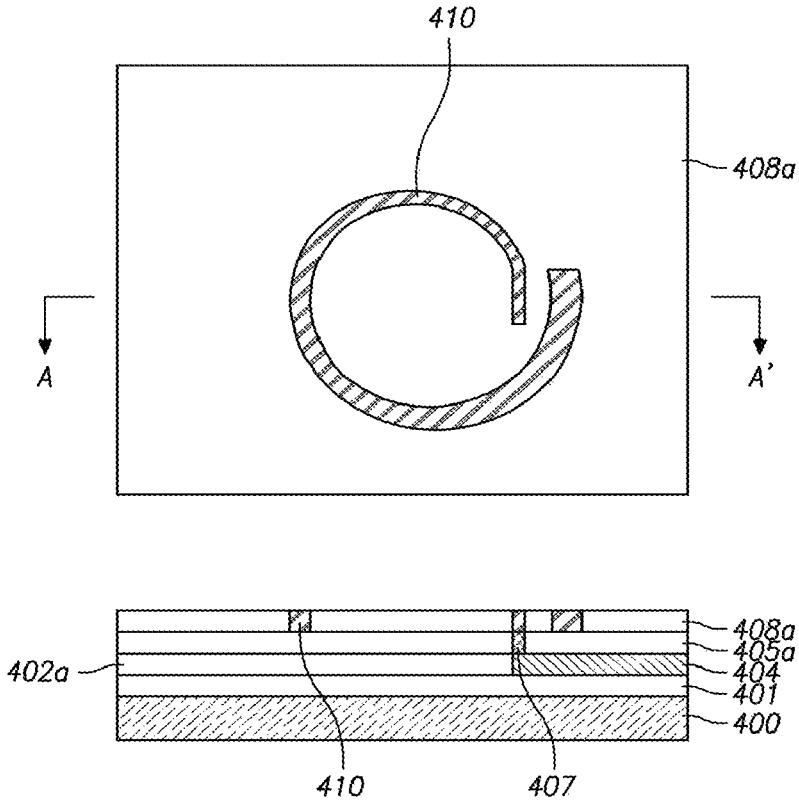

Subsequently, as shown in FIG. 18, after depositing a third metal film on a fourth spiral dielectric layer pattern 408*a*, a planarization process is performed on the third metal film using a chemical mechanical polishing (CMP) method in order to form a first spiral metal line 410. The first spiral metal line 410 also has substantially the same shape as the first spiral metal line 210 of the first embodiment.

Figure 19:
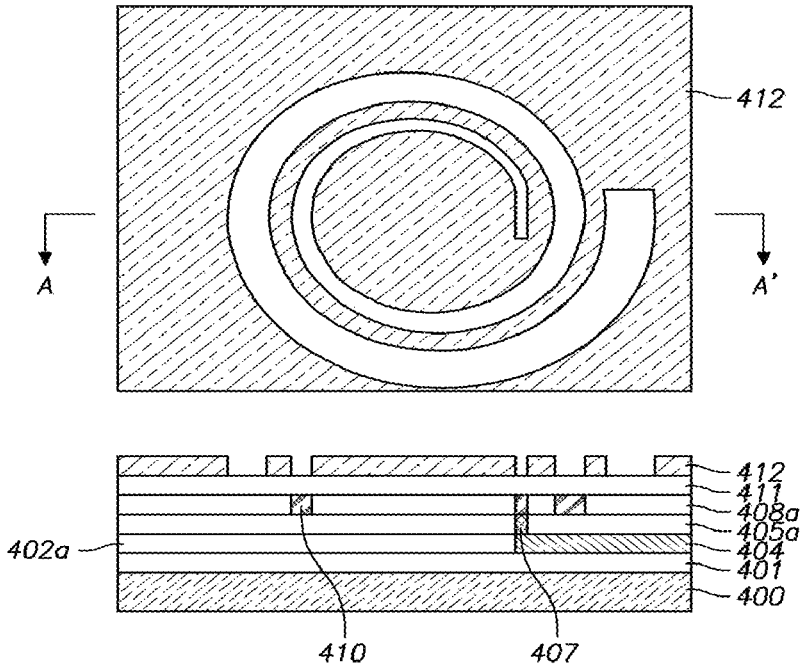

Thereafter, as shown in FIG. 19, a fifth dielectric layer 411 is formed on the first spiral metal line 410 and fourth spiral dielectric layer pattern 408*a*, and a second spiral photo resist pattern 412 is formed on the fifth dielectric layer 411. Here, the second spiral photo resist pattern 412 has an opening with a shape such that the opening of the first spiral photo resist pattern 409 and the opening of the second spiral photo resist pattern 212 in the first embodiment are continuous. Thus, the second spiral photo resist pattern 412 has an opening with two spiral rotations.

Subsequently, as shown in FIG. 20, after forming a fifth spiral dielectric layer pattern 411*a* by performing the etching process using the second spiral photo resist pattern 412, ashing and cleaning processes are performed to remove the second spiral photo resist pattern 412. Thereafter, a fourth metal film is deposited on the fifth spiral dielectric layer pattern 411*a*, and a planarization process is performed on the fourth metal film using a chemical mechanical polishing (CMP) method so as to form a second spiral metal line 413 with a portion that overlaps the first spiral metal line 410.

Next, as shown in FIG. 21, a sixth dielectric layer 414 is formed on the second spiral metal line 413 and fifth spiral dielectric layer pattern 411*a*, and a third spiral photo resist pattern 415 is formed on the sixth dielectric layer 414. The third spiral photo resist pattern 415 has an opening with a shape such that the opening of the second spiral photo resist pattern 412 and the opening of the third spiral photo resist pattern 215 in the first embodiment are continuous. Thus, the third spiral photo resist pattern 415 has an opening with 2.5 spiral rotations.

As shown in FIG. 22, after a sixth spiral dielectric layer pattern 414*a* is formed by performing the etching process using the third spiral photo resist pattern 415, ashing and cleaning processes are performed in order to remove the third spiral photo resist pattern 415. Then, a fifth metal film is deposited on the sixth spiral dielectric film pattern 414*a*, and a planarization is performed using a chemical mechanical polishing (CMP) method so as to form a third spiral metal line 416 with a portion that overlaps with the second spiral metal line 413. Thereafter, a seventh dielectric layer 417 is formed on the third spiral metal line 416 in order to form the circular spiral structure in the inverse cone shape according to the third embodiment.

The spiral inductor according to the third embodiment differs in that the thickness of the metal line is increased stepwise it proceeds from the center portion of the circular spiral, when compared to the spiral inductor according to the first embodiment.

The inductor of the circular spiral structure according to the present invention has a shape such that the width of the metal line is reduced toward the center portion. This increase inductances by reducing the loss due to eddy currents induced from the inductor.

Meanwhile, the third embodiment described above reduces the width of the metal line in order to reduce the section area of the metal line, thereby allowing the resistance of the inductor remain constant.

Accordingly, the width of the metal line has the same form as the first embodiment, while the thickness of the metal line is stepwise increased from the center portion of the circular spiral, thereby preventing the increase in the resistance of the inductor. Thus, the deterioration of the quality factor due to the increase in the resistance of the inductor can be prevented.

Embodiment 4

Figure 23:
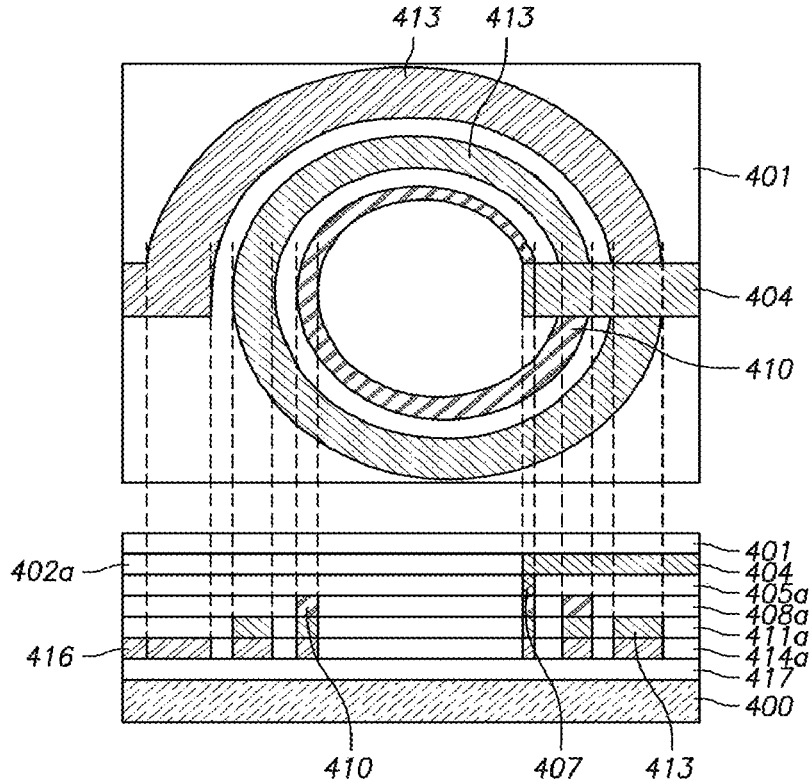
FIG. 23 a projection view and a cross-sectional view illustrating a spiral inductor according to a fourth embodiment of the present invention.

A fourth embodiment of a spiral inductor according to the present invention is shown in FIG. 23. The circular spiral of the spiral inductor shown in the FIG. 23 has a cone shape unlike the third embodiment. That is, the metal line of the bottom layer is the metal line 416, the metal line of the top layer is the metal line 410, and the metal line 410 of the center portion of the circular spiral is disposed at the top layer. Accordingly, the line width of the circular spiral structure is gradually reduced from the metal line 416 disposed at the bottom layer to the metal line 410 disposed at the top layer.

The method for manufacturing the spiral inductor shown in the FIG. 23 is similar to the method of third embodiment, and differs only in the order of photo masks used for forming the spiral photo resist pattern. Thus, the detailed description of the method will be omitted.

Although the preferable embodiments of the present invention have been described above, the present invention can be modified without departing from the essential properties or scope of the present invention by those skilled in the art.

Therefore, the embodiment of the present invention described herein should be considered as illustrative only, rather than as limitations. The scope of the present invention is shown in the claims, rather than the above description, and all differences present within equivalents should be construed as being included in the present invention.

In order to improve the quality factor of the inductor, it is very important to reduce the parasitic resistance of the inductor and improve the inductance.

The spiral inductor of the present invention is formed as the circular spiral structure such that the polarization phenomenon generated at the edges of the straight metal lines in the related art can be prevented. Thus, the resistance of the inductor can efficiently be reduced.

Second, the spiral inductor is formed with a structure such that the width of the metal line is gradually decreased as proceeding from the outer portion to the center portion of the circular spiral, thereby making it possible to reduce the loss due to the eddy current and improve the inductance.

Third, the inductor is formed with a cone shape or the inverse cone shape, making it possible to reduce the parasitic capacitance present between the metal lines.

Fourth, as the line width is increased as proceeding to the outer portion of the spiral structure, the parasitic capacitance generated in the overlapped area of the connecting terminal and the metal lines forming the spiral structure is reduced.

Fifth, the dielectric layer having an appropriate thickness is interposed between the metal line of the bottom layer constituting the inductor and the silicon substrate, making it possible to prevent the generation of an eddy current.

What is claimed is:

1. A spiral inductor comprising:

a dielectric layer formed of a plurality of layers stacked on a semiconductor substrate; and a plurality of curved metal lines disposed in the dielectric layer which are serially connected in order to form a circular spiral shape; and wherein the metal line disposed at the center portion of the circular spiral shape has a first height and the metal line disposed at the outer portion of the circular spiral shape has a second height.

2. The spiral inductor according to claim 1, wherein the metal lines of the circular spiral shape have a width which gradually narrows from a first width in the metal lines of the outer portion of the circular spiral shape to a second width in the metal lines of on a center portion of the circular spiral shape.

3. The spiral inductor according to claim 1, wherein a gap is formed between the plurality of the metal lines, wherein the distance between the plurality of metal lines is constant.

4. The spiral inductor according to claim 1, wherein the first height of the metal line disposed at the center portion of the spiral is higher than the second height of the metal line disposed at the outer portion of the spiral shape, such that the metal lines form a spiral with a conical shape.

5. The spiral inductor according to claim 1, wherein the first height of the metal line disposed at the center portion of the circular is lower than the second height of the metal line disposed at the outer portion of the spiral shape, so that the metal lines form a spiral with an inverted conical shape.

6. The spiral inductor according to claim 1, wherein the thicknesses of the metal lines gradually increase from a first thickness in the metal lines of the outer portion of the circular spiral shape to a second thickness in the metal lines of the center portion of the circular spiral shape.

7. The spiral inductor according to claim 1, wherein the thicknesses of the metal lines are gradually reduced from a first thickness in the metal lines of the outer portion of the circular spiral shape to a second thickness in the metal lines of the center portion of the circular spiral shape.

8. The spiral inductor according to claim 1, further comprising a first connecting terminal connected to an end of the metal line disposed at a center portion of the circular spiral shape; and a second connecting terminal connected to another end of the metal line disposed at an outer portion of the circular spiral shape.

9. The spiral inductor according to claim 8, further comprising at least one dielectric layer placed between the metal line of the center portion of the circular spiral shape connected to the first connecting terminal and other metal lines of the circular spiral shape.

10. The spiral inductor according to claim 8, wherein the plurality of metal lines are interconnected at an area where the plurality of metal lines overlap with the first connecting terminal, as viewed from the top the semiconductor substrate.

11. The spiral inductor according to claim 1, further comprising a dielectric layer disposed between the bottom layer metal line of the plurality of metal lines and the semiconductor substrate.

12. The spiral inductor according to claim 11, wherein the thickness of the dielectric layer is 1 μm or more.

13. A spiral inductor comprising:

a dielectric layer formed of a plurality of layers stacked on a semiconductor substrate;

a plurality of curved metal lines disposed in the dielectric layer which are serially connected in order to form a circular spiral shape;

a first connecting terminal connected to an end of the metal line disposed at a center portion of the circular spiral shape; and a second connecting terminal connected to another end of the metal line disposed at an outer portion of the circular spiral shape;

wherein the curved metal line disposed at the center portion of the circular spiral shape has a first height and the curved metal line disposed at the outer portion of the circular spiral shape has a second height.

14. The spiral inductor according to claim 13, wherein the thickness of the dielectric layer is 1 μm or more.

15. The spiral inductor according to claim 13, wherein the metal lines of the circular spiral shape have a width which gradually narrows from a first width in the metal lines of the outer portion of the circular spiral shape to a second width in the metal lines of on a center portion of the circular spiral shape.

16. The spiral inductor according to claim 13, wherein the first height of the metal line disposed at the center portion of the spiral is higher than the second height of the metal line disposed at the outer portion of the spiral shape, such that the metal lines form a spiral with a conical shape.

17. The spiral inductor according to claim 13, wherein the first height of the metal line disposed at the center portion of the circular is lower than the second height of the metal line disposed at the outer portion of the spiral shape, so that the metal lines form a spiral with an inverted conical shape.

18. The spiral inductor according to claim 13, wherein the thicknesses of the metal lines gradually increase from a first thickness in the metal lines of the outer portion of the circular spiral shape to a second thickness in the metal lines of the center portion of the circular spiral shape.

19. The spiral inductor according to claim 13, wherein the thicknesses of the metal lines are gradually reduced from a first thickness in the metal lines of the outer portion of the circular spiral shape to a second thickness in the metal lines of the center portion of the circular spiral shape.

20. The spiral inductor according to claim 13, further comprising at least one dielectric layer placed between the metal line of the center portion of the circular spiral shape connected to the first connecting terminal and other metal lines of the circular spiral shape.

21. The spiral inductor according to claim 13, wherein the plurality of metal lines are interconnected at an area where the plurality of metal lines overlap with the first connecting terminal, as viewed from the top the semiconductor substrate.

22. The spiral inductor according to claim 13, wherein a gap is formed between the plurality of the metal lines, wherein the distance between the plurality of metal lines is constant.

23. The spiral inductor according to claim 13, further comprising a dielectric layer disposed between the bottom layer metal line of the plurality of metal lines and the semiconductor substrate.

24. A spiral inductor comprising:

a dielectric layer formed of a plurality of layers stacked on a semiconductor substrate; and a plurality of curved metal lines disposed in the dielectric layer which are serially connected in order to form a circular spiral shape; and wherein the thicknesses of the metal lines gradually increase from a first thickness in the metal lines of an outer portion of the circular spiral shape to a second thickness in the metal lines of a center portion of the circular spiral shape.

25. A spiral inductor comprising:

a dielectric layer formed of a plurality of layers stacked on a semiconductor substrate; and a plurality of curved metal lines disposed in the dielectric layer which are serially connected in order to form a circular spiral shape; and wherein the thicknesses of the metal lines are gradually reduced from a first thickness in the metal lines of an outer portion of the circular spiral shape to a second thickness in the metal lines of a center portion of the circular spiral shape.

* * * * *